United States Patent [19]

Spitzer et al.

[11] Patent Number: 4,988,003

[45] Date of Patent: Jan. 29, 1991

[54] STACKABLE TRAY CARRYING UNITS

[75] Inventors: Charles M. Spitzer, Roslyn Heights, N.Y.; Paul F. Siegel, Ridgefield, Conn.

[73] Assignee: A-Bee Syndicate, Inc., New York, N.Y.

[21] Appl. No.: 479,836

[22] Filed: Feb. 14, 1990

[51] Int. Cl.[5] ..... B65D 21/02

[52] U.S. Cl. ..... 206/511; 211/71; 211/133; 220/236

[58] Field of Search ..... 220/23.6; 206/511, 512; 211/71, 126, 133

[56] References Cited

U.S. PATENT DOCUMENTS

| | | | |
|---|---|---|---|
| 4,366,905 | 1/1983 | Forshoe | 206/511 |
| 4,386,703 | 6/1983 | Thompson | 211/126 |
| 4,401,216 | 8/1983 | Koch | 220/23.6 |
| 4,428,487 | 1/1987 | Hepp | 211/126 |
| 4,711,355 | 8/1987 | Veenman | 206/512 |

FOREIGN PATENT DOCUMENTS

| | | | |
|---|---|---|---|
| 1365477 | 5/1964 | France | 206/512 |
| 2494080 | 5/1982 | France | 206/512 |

*Primary Examiner*—George E. Lowrance

*Attorney, Agent, or Firm*—McAulay Fisher Nissen & Goldberg

[57] ABSTRACT

A stackable set of tray carrying units is disclosed wherein each unit has a floor member and a ceiling member. Each of the floor and ceiling members has downwardly extending feet, and the ceiling member also has upwardly extending split posts. The floor and ceiling members are connected together by vertical beams having upper and lower I-beam extensions which frictionally engage with the respective feet of the ceiling and floor members. The stacking arrangement is such that each of the split posts of the ceiling member is sized to frictionally fit within one of the feet of a floor member assembled on top of the ceiling member, with the web of the lower I-beam extension of a beam in an upper one of such units having an interference fit with the space defined by the split post of a lower one of such units.

21 Claims, 4 Drawing Sheets

STACKABLE TRAY CARRYING UNITS

BACKGROUND OF THE INVENTION

I. Field of the Invention

This invention relates to stackable tray or drawer carrying units and, in particular, to an improved stackable set of such tray carrying units having portions thereof interconnected in an interference fit relation.

II. Description of the Prior Art

Stackable tray carrying units are well-known wherein the opposite ends of the corner leg members fit within complementary shaped openings in the top and bottom panel members to define a frame for receiving and supporting a plurality of trays in sliding relation to the unit. The leg members and panel members come in varying lengths to accommodate trays of different sizes.

Heretofore, the stackable tray carrying units, generally, were not connected together in a sturdy interfitting relation. The units had a tendency to come apart when in use, or when moved from one place to another, with the result that the trays would fall out of the units spilling the contents on the floor. In other instances where the units were designed so as not to easily come apart, the resulting designs were not easily assembled. In still other situations, the assembly required the use of special tools which, in and of itself, necessitated some degree of skill on the part of the person doing the assembly.

The present invention provides an improved stackable tray carrying unit which eliminates many of the problems and drawbacks of the heretofore known units in the manner hereinafter described.

SUMMARY OF THE INVENTION

The invention provides for each of the tray carrying units to have a floor member and a ceiling member. Both of the floor and ceiling members have four downwardly extending corner feet. The ceiling member also is formed having four upwardly extending corner split posts.

The floor and ceiling members are connected together by four vertical corner beams each having upper and lower I-beam extensions. Each I-beam extension is formed having first and second flanges connected by a central web.

For purpose of assembling the unit into a frame structure, each corner foot of the floor member has a vertical through-opening sized to frictionally receive one of the lower I-beam the corner beams. Also, each of the corner feet of the ceiling member is in the form of an inverted hollow cup having an open end sized to frictionally receive and contain one of the upper I-beam extensions of one of the corner beams.

Each of the corner split posts which extends upwardly from the ceiling member has first and second portions spaced from one another by a predetermined distance to define a space therebetween. The predetermined distance defining this space is less than the thickness of the central web of the I-beam extensions. The arrangement is such that each of the split posts is sized to fit within one of the corner feet of a floor member assembled on top thereof, with the central web of a lower I-beam extension of a beam in an upper one of the units having an interference fit with the space defined by the split post of a lower one of the units.

The number of trays carried by each unit is a function of the configuration of the frame defining the unit. For example, the frame is provided with support surfaces to facilitate insertion of one or more trays in sliding contact with such support surfaces. At least some of these support surfaces are defined by guide rails on the floor member. In another configuration of the frame, a pair of corner beams on each side of the unit are connected together by a brace member defining side shelf support surfaces spaced above the floor support surfaces. The side shelf support surfaces and the floor support surfaces are disposed to facilitate insertion of a plurality of trays in the unit in sliding contact with selected ones of the support surfaces.

In still another configuration, the floor member and the ceiling member each have additional downwardly extending feet located between the respective corner feet of such members and adjacent to the front and back edges thereof. The unit also is provided with additional vertical beams having upper and lower I-beam extensions. The additional feet of the floor member, similar to the corner feet of such member, have vertical through-openings sized to frictionally receive one of the lower I-beam extensions of one of the additional I-beams. Also, as previously noted in describing the corner feet of the ceiling member, the additional feet of such member similarly are in the form of an inverted hollow cup having an open end sized to frictionally receive and contain one of the upper I-beam extensions of one of the additional beams.

As was the case with the pair of corner beams on each side of the unit, a pair of the additional beams are connected together by a brace member defining additional shelf support surfaces. These additional shelf support surfaces may extend from one side or from opposite sides of the brace member, and are spaced above the floor support surfaces. Here, again, the side shelf support surfaces and the additional shelf support surfaces and the floor support surfaces are disposed to facilitate insertion of a plurality of trays in the unit in sliding contact with selected ones of the support surfaces.

Other desirable features in the present units include forming the trays with a recessed bottom surface portion to define edge runner portions disposed in contact with the associated support surfaces to facilitate insertion and withdrawal of the trays relative to the unit. A finger gripping handle portion also is provided on the front surface of each tray to facilitate insertion and withdrawal of the trays relative to the unit. An upstanding post also is located at the rear of the support surfaces disposed in the path of travel of an associated tray so as to be engaged by the rear wall of the tray to limit the extent to which the tray is inserted in the unit.

Additional features and advantages of the present invention will become more apparent from a consideration of the following detailed description when taken in conjunction with the accompanying drawings.

DESCRIPTION OF THE PREFERRED EMBODIMENT

Figure 1:
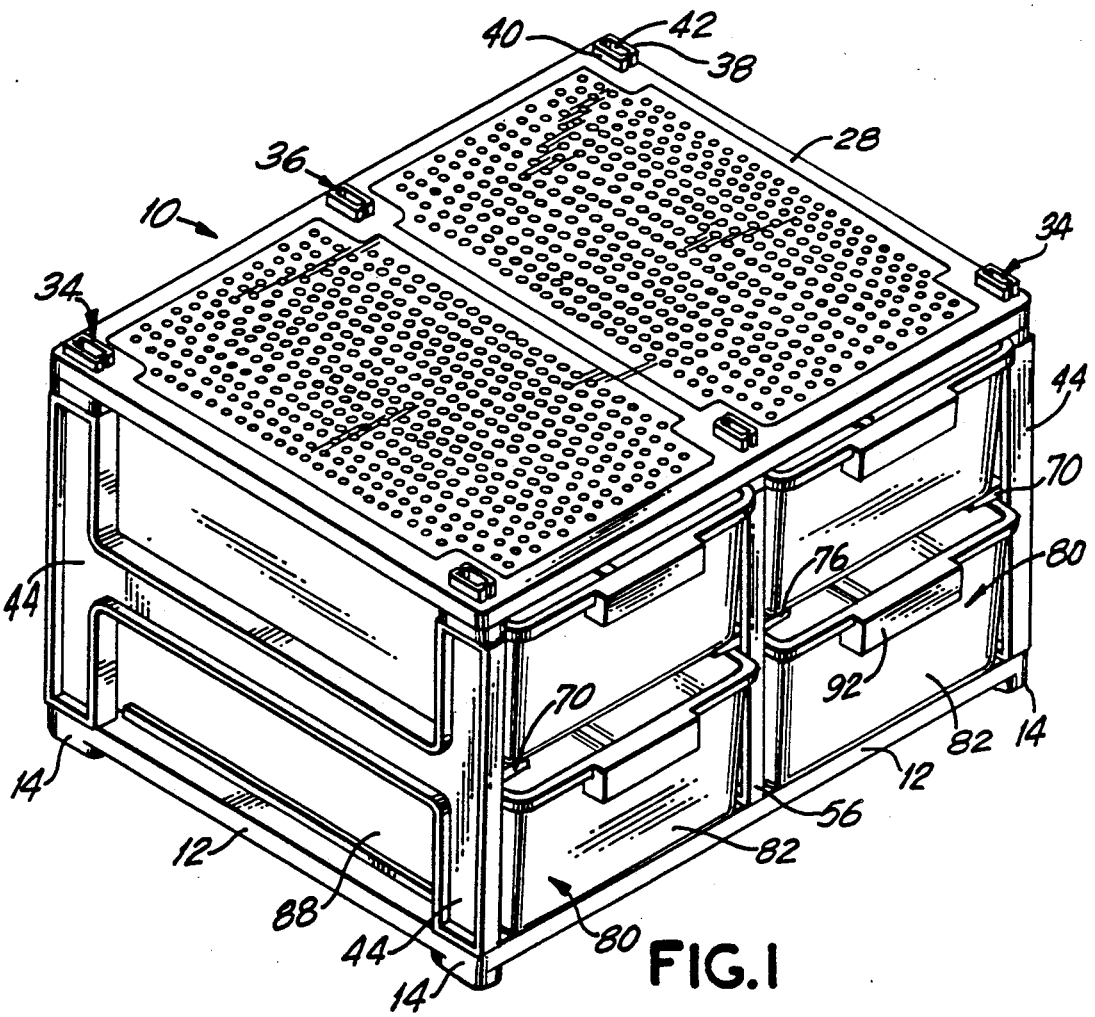
FIG. 1 is a perspective view of one of the stackable tray carrying units constructed in accordance with the present invention.
Figure 2:
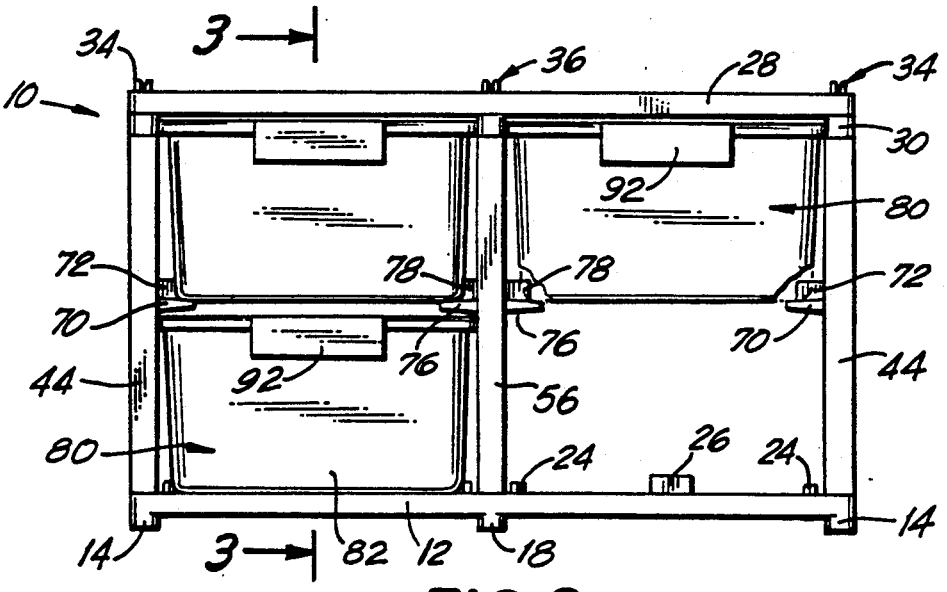
FIG. 2 is a front elevational view of the unit of FIG. 1, with parts broken away and with one of the trays removed to show various features of the unit.
Figure 3:
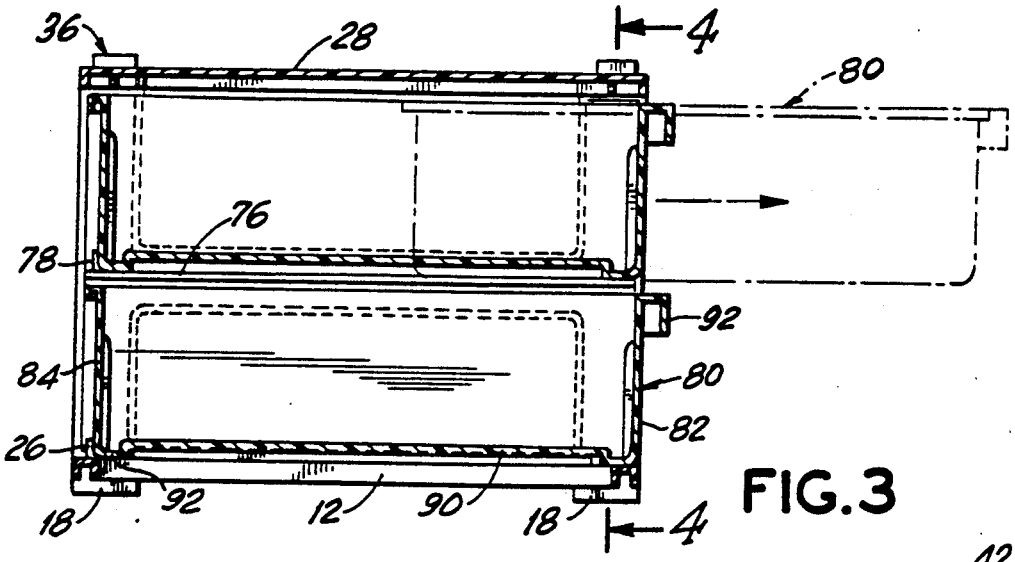
FIG. 3 is a sectional view taken along line 3—3 of FIG. 2, with one of the trays shown in phantom line in the direction of withdrawal from the unit.

Referring to the drawings, particularly FIGS. 1-5, numeral 10 represents a tray carrying unit constructed in accordance with the present invention. Unit 10 includes a floor member 12 having downwardly extending corner feet 14 formed with a vertical through-opening 16. Disposed between corner feet 14, approximately midway the length of floor member 12 and adjacent the front and back edges thereof, are additional downwardly extending feet 18 also having vertical through-openings 20. The feet 14, 18 are disposed to frictionally receive within the respective through-openings 16, 20 one end of vertical beams in a manner hereinafter described.

Floor member 12 defines support surfaces 22 on which one or more trays, as hereinafter noted, are supported in sliding contact with the support surfaces. Floor member 12 also includes upright guide rails 24 which define the support surfaces 22 to facilitate insertion of the trays in unit 10. An upstanding post 26 is provided at the back of floor member 12 which is disposed in the path of travel of each tray on support surfaces 22 to limit the extent to which the tray is inserted in the unit.

Unit 10 also includes a ceiling member 28 having downwardly extending corner feet 30 in the form of an inverted hollow cup. Disposed between corner feet 30, approximately midway the length of ceiling member 28 and adjacent the front and back edges thereof, may be additional downwardly extending feet 32 also in the form of inverted hollow cups. The feet 30, 32 have open ends disposed to frictionally receive and contain therein an opposite end of the vertical beams as hereinafter described.

Ceiling member 28 also includes upwardly extending corner split posts represented generally by numeral 34. Disposed between corner posts 34, approximately midway the length of ceiling member 28 and adjacent the front and back edges thereof, may be additional upwardly extending split posts 36. Each of the split posts 34, 36 is formed having first and second portions 38 and 40, respectively, spaced from one another a predetermined distance to define a space 42 therebetween. The space 42 between post portions 38, 40 is such as to frictionally receive therebetween and end of a vertical beam from a tray carrying unit assembled on top of ceiling member 28 as hereinafter described.

The corner vertical beams of unit 10 which connect floor member 12 and ceiling member 28 together into an assembled frame are identified by numeral 44. Beams 44 are shown as I-beams each having upper and lower extensions represented generally by numerals 46 and 48, respectively. Each of extensions 46, 48 is formed having first and second flanges 50 and 52 connected by a central web 54. As will hereinafter become apparent, the upper corner I-beam extensions 46 fit within the associated corner feet 30 of ceiling member 28 whereas the lower I-beam extensions 48 fit within the associated corner feet 14 of floor member 12.

It will be appreciated that the corner feet 14, 30, at each corner of unit 10, are in vertical alignment with each other. Also, the flanges 50, 52 are tapered so as to have an increasing dimension, when viewed in cross section, beginning at the free ends thereof and increasing lengthwise of the beam. That is, the upper and lower I-beam extensions 46, 48 initially are freely received within the associated corner feet 30 and 14, respectively, in a slip fit relationship. However, as the I-beam extensions continue to be inserted into the associated feet, the tapered flanges 50, 52 engage with inner wall surfaces of said feet to define an interference fit relationship when the extensions are fully inserted in place. This serves to provide a sturdy and secure frame for the unit. It will be further appreciated that the tapered configuration of the interfitting parts could be altered wherein the taper is formed along the inner walls of the feet. That is, the inner walls taper inwardly to frictionally engage, in this instance, with non-tapered extensions of the I-beams.

Figure 5:
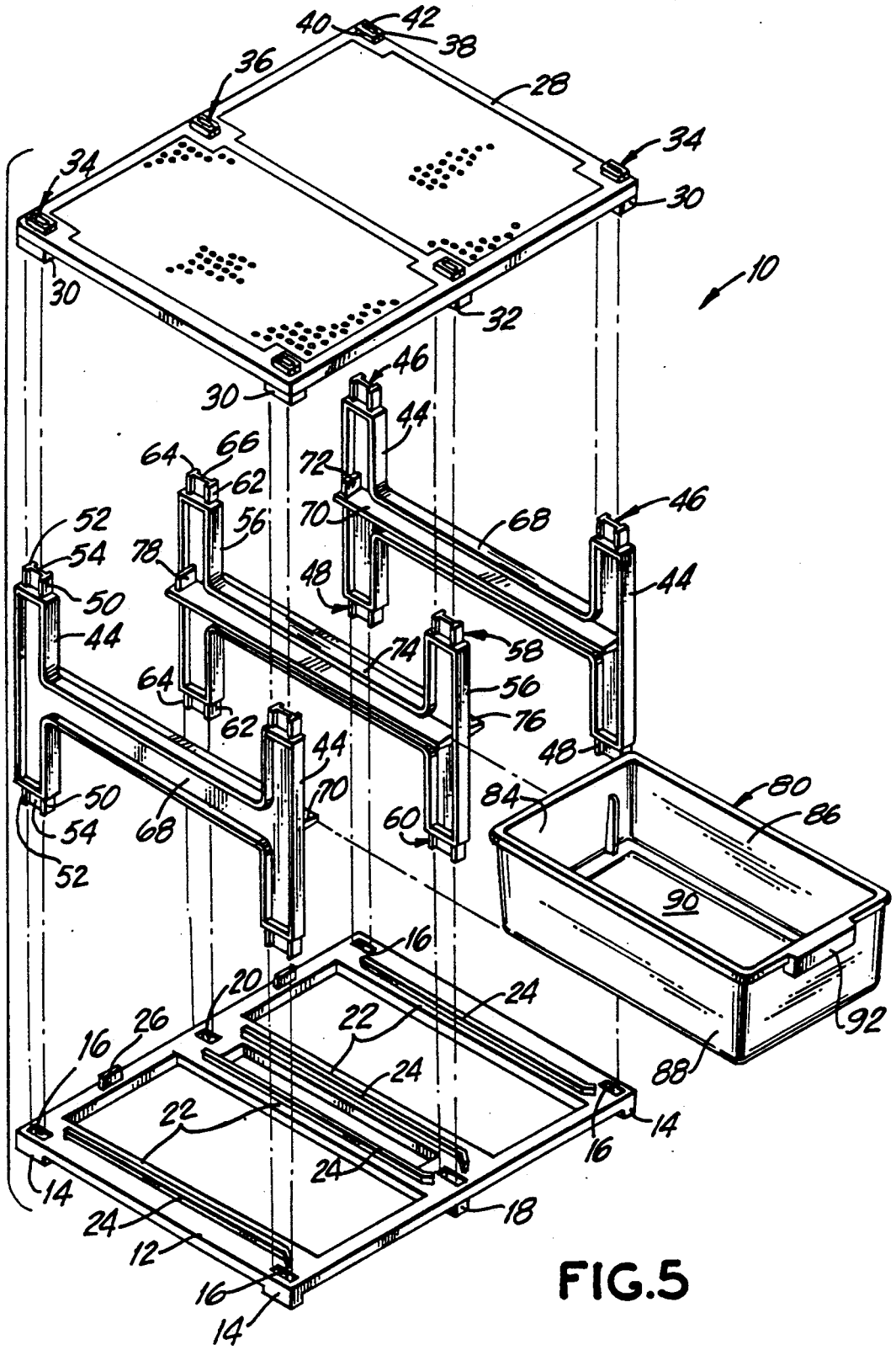
FIG. 5 is an exploded perspective view of the components which make up the unit of FIG. 1, showing only one tray for purpose of clarity.

In those instances where unit 10 is to support trays in side-by-side relation as shown in FIG. 1, it will be necessary to provide for additional vertical I-beams 56 disposed between the corner beams 44 approximately midway the length of the unit. Specifically, as shown in FIG. 5, beams 56 are constructed similar to corner beams 44 having upper and lower extensions 58 and 60 each having first and second flanges 62 and 64 connected by a central web 66. It will now be further apparent that the upper I-beam extensions 58 frictionally fit within the associated additional feet 32 of ceiling member 28 whereas the lower I-beam extensions 60 frictionally fit within the associated additional feet 18 of floor member 12.

Figure 6:
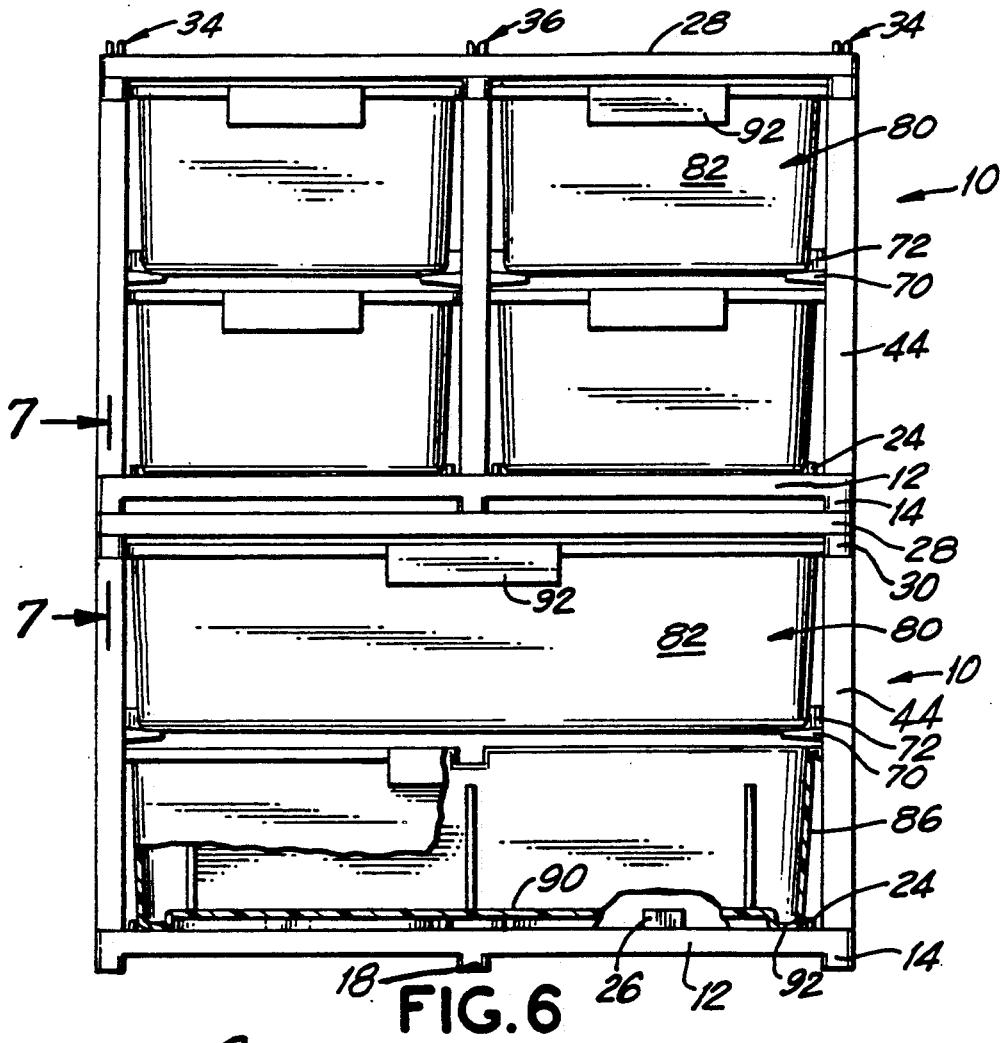
FIG. 6 is a front elevational view of a set of such tray carrying units stacked one on top the other, with parts in section and parts broken away.
Figure 7:
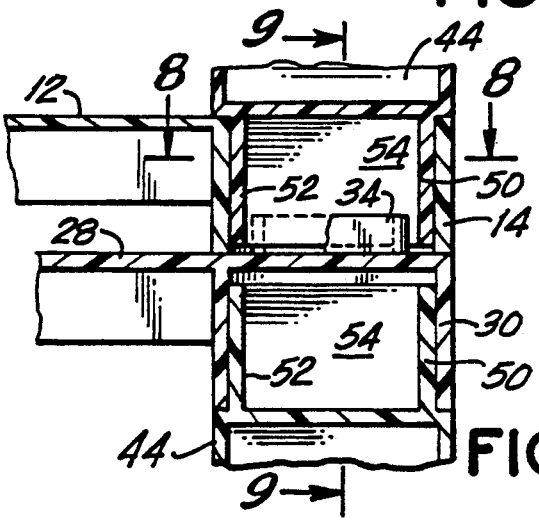
FIG. 7 is a sectional view taken along line 7—7 of FIG. 6.
Figure 9:
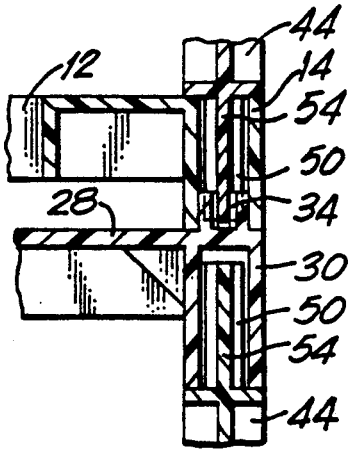
FIG. 9 is a sectional view taken along line 9—9 of FIG. 7.
Figure 8:
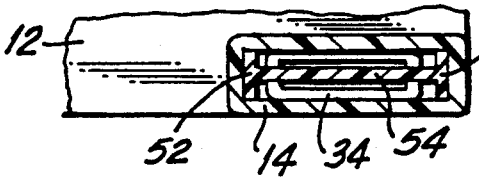
FIG. 8 is a sectional view taken along line 8—8 of FIG. 7.

The pair of corner I-beams 44 on each side of unit 10 are connected together by a brace member 68 which defines side shelf support surfaces 70. Brace 68 is disposed approximately midway the height of beam 44. Support surfaces 70 facilitate insertion of a tray in sliding contact with such services as seen in FIG. 6. Also, an upstanding post 72 is provided at the back of support surfaces 70 which is disposed in the path of travel of the tray to limit the extent to which the tray is inserted in the unit.

In similar fashion, the additional I-beams 56 are connected together by a brace 74 defining additional shelf support surfaces 76 extending from opposite sides of brace 74. This is shown in FIGS. 1, 2, 4 and 5 and is required when trays are supported in side-by-side relation. Depending on the configuration of the trays to be carried by the unit, the additional shelf support surface 76 may extend from only one side of brace 74. Here, again, upstanding posts 78 are provided at the back of support surfaces 76 and function similar to post 72 to limit the extent to which the trays are inserted in the unit.

The trays to be supported and carried by unit 10 are designated by numeral 80 and may vary in size. This is depicted in FIG. 6. Also, with reference to FIGS. 1 and 4, each tray 80 has a front wall 82, a baok wall 84, side walls 86 and 88, and bottom wall 90. The bottom wall 90 has a recessed surface to define edge runner portions 92 extending longitudinally of tray 80, which runners 92 are in contact with the support surfaces 22, 70 or 74, as the case may be, to facilitate insertion and withdrawal of the tray relative to unit 10. A finger gripping handle portion 94 is associated with front wall 82 to facilitate handling of tray 80. As is also apparent in FIGS. 2, 3 and 4, the upright posts 72, 78 are disposed to be engaged by the back wall 84 of tray 80 to limit further inserted movement of tray 80 within unit 10.

Figure 4:
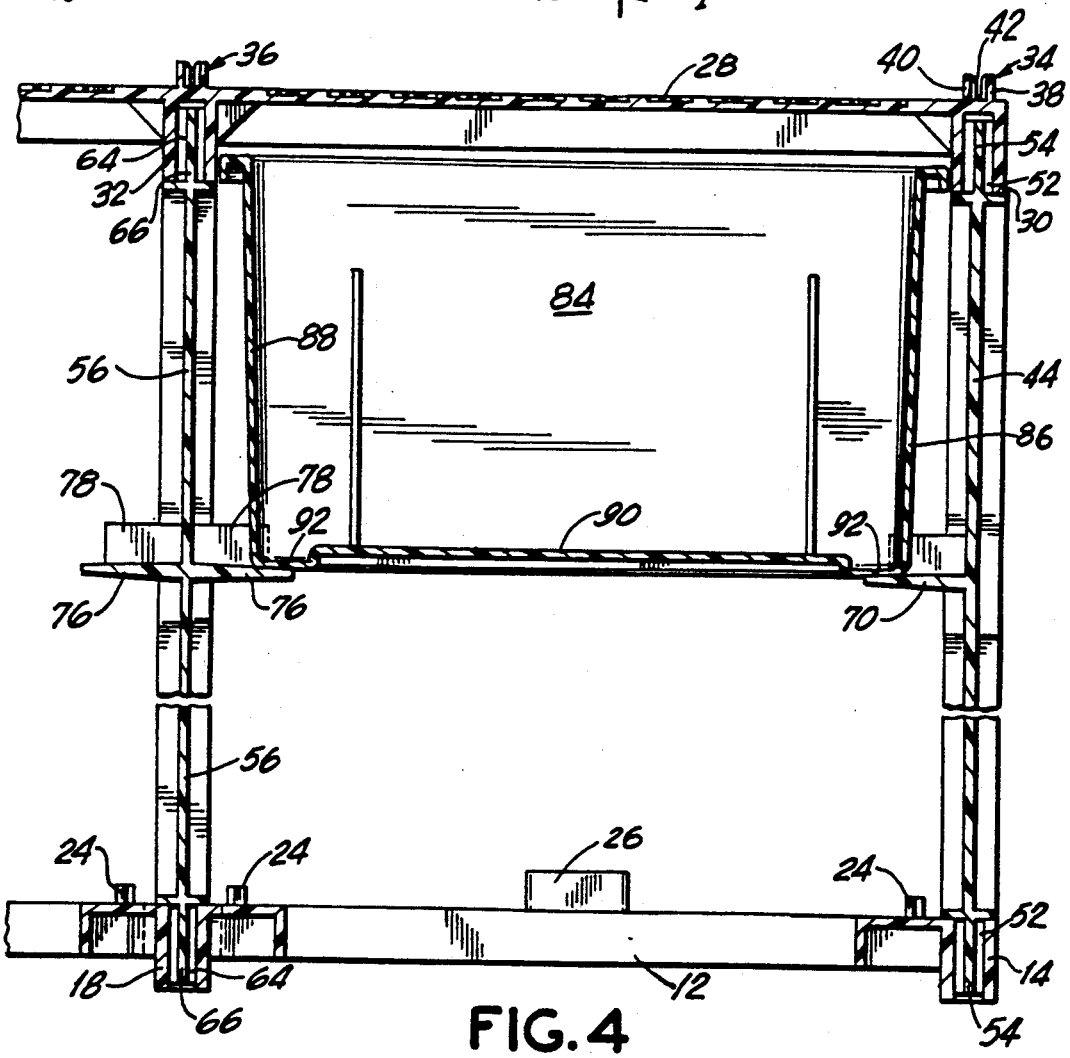
FIG. 4 is a sectional view taken along line 4—4 of FIG. 3.

FIGS. 6–9 illustrate the manner for stacking a set of tray carrying units 10 on top of each other. In describing the manner in which this stacking arrangement takes place, reference also should be made to the configuration of the upper and lower I-beam extensions 46, 48 of corner I-beams 44, and the corresponding I-beam extensions 58, 60 of additional I-beams 56, as shown in FIGS. 1 and 4. Specifically, with reference to corner I-beams 44, the length of web 66 is greater than the length of the corner split posts 34. The webs 66 may, in effect, be considered as blades which have a thickness greater than the predetermined distance or space 42 between the spaced-apart first and second portions 38, 40 of posts 34. As such, when another floor member 12 is positioned on top of ceiling member 28, each of the split posts 34 will frictionally fit within the corner feet 14 of such other floor member. In doing so, the web 54 of a lower I-beam extension 48 of an I-beam 44 associated with the upper unit 10 will be received within the space 42 defined by the split post 34 of a lower one of such units 10 in an interference fit relation.

The components that make up unit 10 are each made of plastic material, such as high to medium impact polystyrene, using conventional molding techniques. The trays are made of polypropylene with a clarifying agent so as to render visible the contents within the tray.

While a preferred embodiment of the invention has been shown and described in detail, it will be readily understood and appreciated that numerous omissions, changes and additions may be made without departing from the spirit and scope of the invention.

We claim:

1. A stackable set of tray carrying units having at least an upper unit and a lower unit, each of said units comprising:

a floor member having four downwardly extending corner feet; and a ceiling member having four downwardly extending corner feet and four upwardly extending corner split posts; and four vertical corner beams, each of said corner beams having upper and lower extensions;

each of said lower extensions including a blade portion;

each corner foot of said floor member having a vertical through-opening sized to receive one of said lower extensions of one of said corner beams;

each of said corner feet of said ceiling member being in the form of an inverted hollow cup having an open end, the cup of each of said corner feet being sized to receive one of said upper extensions of one of said corner beams;

each of said split posts having first and second portions spaced from one another a predetermined distance to define a space therebetween, said predetermined distance between said spaced-apart first and second portions of said posts being less than the thickness of said blade portion of said lower extensions;

each of said split posts being sized to fit within one of said corner feet of a floor member of one of said units assembled on top thereof; and said blade portion of said lower extension of a beam in an upper one of said units having an interference fit relation with the space defined by the split post of a lower one of said units.

2. A stackable set of tray carrying units having at least an upper unit and a lower unit, each of said units comprising:

a floor member having four downwardly extending corner feet; and a ceiling member having four downwardly extending corner feet and four upwardly extending corner split posts; and four vertical corner beams, each of said corner beams having upper and lower I-beam extensions;

each of said I-beam extensions having first and second flanges connected by a central web;

each corner foot of said floor member having a vertical through-opening sized to receive one of said lower I-beam extensions of one of said corner beams;

each of said corner feet of said ceiling member being in the form of an inverted hollow cup having an open end, the cup of each of said corner feet being sized to receive and contain one of said upper I-beam extensions of one of said corner beams;

each of said split posts having first and second portions spaced from one another a predetermined distance to define a space therebetween, said predetermined distance between said spaced-apart first and second portions of said posts being less than the thickness of said central web of said I-beam extensions;

each of said split posts being sized to fit within one of said corner feet of a floor member of one of said units assembled on top thereof; and the central web of a lower I-beam extension of a beam in an upper one of said units having an interference fit relation with the space defined by the split post of a lower one of said units.

3. The set of units of claim 2, wherein each of said upper I-beam extensions has an interference fit relationship to a respective one of said feet of said ceiling member and each of said lower I-beam extensions has an interference fit relationship with a respective one of said feet of said floor member, thereby defining one of said tray carrying units.

4. The set of tray carrying units of claim 3, wherein the length of said web of each of said I-beam extensions is greater than the length of the associated split post, said flanges of said I-beam extensions having said interference fit relationship with inner surfaces of said feet.

5. The set of tray carrying units of claim 1, wherein said floor member has tray support surfaces, and each of said units further comprises guide rails on said floor member to facilitate insertion of one or more trays in the associated unit in sliding contact with said support surfaces.

6. The set of tray carrying units of claim 5, wherein each of said trays has a recessed bottom surface portion to define edge runner portions extending longitudinally of the tray, the runners of at least one tray being disposed in contact with said support surfaces to facilitate insertion and withdrawal of said tray relative to said unit.

7. The set of tray carrying units of claim 5, further comprising a finger gripping handle portion on a front surface of each such tray to facilitate insertion and withdrawal of said tray relative to said unit.

8. The set of tray carrying units of claim 5, wherein said unit further comprises stop means to limit the extent to which each such tray is inserted in said unit.

9. The set of tray carrying units of claim 8, wherein said stop means comprises an upstanding post located at the back of said support surfaces, said post disposed in the path of travel of said tray so as to be engaged by a back wall of said tray to limit further inserted movement thereof.

10. The set of tray carrying units of claim 5, wherein a pair of said corner beams on each side of said unit are connected together by a brace member defining side shelf support surfaces, said side shelf support surfaces being spaced above said floor support surfaces; whereby said side shelf support surfaces and said floor support surfaces are disposed to facilitate insertion of a plurality of trays in the associated unit in sliding contact with selected ones of said support surfaces.

11. The set of tray carrying units of claim 10, wherein each of said trays has a recessed bottom surface portion to define edge runner portions extending longitudinally of the tray, the runners of at least one tray being disposed in contact with said support surfaces to facilitate insertion and withdrawal of said tray relative to said unit.

12. The set of tray carrying units of claim 10, further comprising a finger gripping handle portion on a front surface of each such tray to facilitate insertion and withdrawal of said tray relative to said unit.

13. The set of tray carrying units of claim 10, wherein said unit further comprises stop means to limit the extent to which each such tray is inserted in said unit.

14. The set of tray carrying units of claim 13, wherein said stop means comprises an upstanding post located at the back of said support surfaces, said post disposed in the path of travel of said tray so as to be engaged by a back wall of said tray to limit further inserted movement thereof.

15. The set of tray carrying units of claim 2, wherein:

said floor member has additional downwardly extending feet located between the corner feet and adjacent to the front and back edges of said member; and said ceiling member has additional downwardly extending feet located between the corner feet and adjacent to the front and back edges of said member;

one of said units further comprising additional vertical beams having upper and lower I-beam extensions;

each of the additional feet of said floor member having a vertical through-opening sized to frictionally receive one of the lower I-beam extensions of one of said additional beams; and each of the additional feet of said ceiling member being in the form of an inverted hollow cup having an open end, the cup of each of said additional feet being sized to frictionally receive and contain one of the upper I-beam extensions of one of said additional beams.

16. The set of tray carrying units of claim 15, wherein:

each of said additional I-beam extensions has first and second flanges connected by a central web; and said ceiling member has additional upwardly extending split posts located between the corner split posts and adjacent to the front and back edges of said member;

each of said additional split posts having first and second portions spaced from one another a predetermined distance to define a space therebetween, said predetermined distance between said spaced-apart first and second portions of said additional posts being less than the thickness of said central web of said additional I-beam extensions;

each of said additional split posts being sized to fit within one of said additional feet of a floor member of one of said units assembled on top thereof; and the central web of the lower I-beam extension of an additional beam in an upper one of said units having an interference fit relation with the space defined by the additional split post of a lower one of said units.

17. The set of tray carrying units of claim 15, wherein said floor member has tray support surfaces, and each of said units further comprises guide rails on said floor member to facilitate insertion of one or more trays in the associated unit in sliding contact with said support surfaces.

18. The set of tray carrying units of claim 17, wherein a pair of said corner beams on each side of said unit are connected together by a brace member defining side shelf support surfaces, and wherein a pair of said additional beams are connected together by a brace member defining additional shelf support surfaces; said additional shelf support surfaces extending from opposite sides of said brace member; said side shelf support surfaces and said additional shelf support surfaces being spaced above said floor support surfaces; whereby said side shelf support surfaces and said additional shelf support surfaces and said floor support surfaces are disposed to facilitate insertion of a plurality of trays in the associated unit in sliding contact with selected ones of said support surfaces.

19. The set of tray carrying units of claim 18, wherein each of said trays has a recessed bottom surface portion to define edge runner portions extending longitudinally of the trays, the runners of said trays disposed in contact with the associated support surfaces to facilitate insertion and withdrawal of said trays relative to said unit.

20. The set of tray carrying units of claim 18, further comprising a finger gripping handle portion on a front surface of said trays to facilitate insertion and withdrawal of said trays relative to said unit.

21. The set of tray carrying units of claim 18, wherein said unit further comprises stop means to limit the extent to which said trays are inserted in said unit.

* * * * *